US005435222A

United States Patent [19]

Leonard

[11] Patent Number: 5,435,222

[45] Date of Patent: Jul. 25, 1995

[54] SINGLE TRIGGER MINOR THIRD ATTACHMENT SHORT REACH SLIDE TROMBONE

[76] Inventor: B. P. Leonard, 1849 Brookfield Dr., Akron, Ohio 44313

[21] Appl. No.: 63,499

[22] Filed: May 18, 1993

[51] Int. Cl.[6] ..... G10D 7/10

[52] U.S. Cl. ..... 84/396; 84/388

[58] Field of Search ..... 84/395, 396, 388, 394

[56] References Cited

U.S. PATENT DOCUMENTS

| | | | |
|---|---|---|---|
| 468,116 | 2/1892 | Robinson . | |
| 530,781 | 12/1894 | Leland | 84/396 |
| 932,704 | 8/1909 | Holton | 84/396 |
| 1,428,675 | 9/1922 | Alschausky | 84/396 |
| 2,027,340 | 1/1936 | Holton . | |
| 2,093,993 | 9/1937 | Adriani . | |
| 3,631,755 | 1/1972 | Glantz et al. . | |
| 3,886,837 | 6/1975 | Veneklasen | 84/396 |
| 3,903,779 | 9/1975 | McCracken . | |
| 4,273,020 | 6/1981 | Happe . | |
| 4,831,911 | 5/1989 | Wanner . | |

FOREIGN PATENT DOCUMENTS

| | | |
|---|---|---|
| 1293357 | 4/1962 | France . |
| 424455 | 5/1991 | France . |

OTHER PUBLICATIONS

A Survey of Musical Instruments, Sibyl Marcuse, 1975 pp. 812–813.

Dictionary of Music and Musicians, Eric Blom, 1954 pp. 552–555.

Declaration for the Purpose of Disclosing a Prior Art Sale, by B. P. Leonard, dated Dec. 1, 1993.

*Primary Examiner*—Michael L. Gellner

*Assistant Examiner*—Cassandra C. Spyrou

*Attorney, Agent, or Firm*—Hudak & Shunk Co.

[57] ABSTRACT

A slide trombone is provided which has an activatable attachment which lengthens the basic windpath of the instrument. The attachment is activated to lower the basic pitch of the instrument by a minor third. The instrument further has a reach (i.e., the distance which the slide travels from its innermost position to its outermost position) which does not exceed 55 centimeters. Thus, when the trombone is tuned to B♭/G♮, the slide has a shorter reach than is conventional for a B♭/F or other known B♭/G♮, trombones. Therefore, for the B♭/G♮, trombone, the slide may lower the pitch by five complete semitones. The trombone can also be tuned to C/A, D♭/B♭, E♭/C, and F/D. In the D♭/B♭ embodiment, the trigger action may be reversed.

12 Claims, 4 Drawing Sheets

Bb/F
Bb4
F4
D4
C4
Bb3
A3
F3
C3
Bb2
F2
Bb1
F1
VIII
VII
VI
V
IV
III
II
I
(o)
(o)
TONES OF THE CHROMATIC SCALE
1st
2nd
3rd
4th
5th
6th
7th
SLIDE-POSITION

Bb/G
Bb4
F4
D4
C4
Bb3
G3
F3
D3
Bb2
G2
Bb1
G1
VIII
VII
VI
V
IV
III
II
I
TONES OF THE CHROMATIC SCALE
1st
2nd
3rd
4th
5th
6th
SLIDE-POSITION

C/A
TONES OF THE CHROMATIC SCALE
C5
G4
E4
C4
A3
G3
E3
C3
A2
C2
A1
VIII
VII
VI
V
IV
III
II
I
1st
2nd
3rd
4th
5th
6th
7th
SLIDE-POSITION

SINGLE TRIGGER MINOR THIRD ATTACHMENT SHORT REACH SLIDE TROMBONE

FIELD OF INVENTION

The present invention relates to trombones, and more particularly to slide trombones achieving better technical facility. In particular, the present invention relates to trombones having which has an attachment lowering the pitch by a minor third. The basic pitch can be B♭, C tenor, D♭, E♭, or F, alto for example.

DESCRIPTION OF THE PRIOR ART

The slide trombone is a brass wind instrument which relies on varying the length of tubing through which air passes to vary the pitch of the resulting sound. Generally, a slide trombone player will vary the length of tube and the resulting sound pitch by selectively telescoping the trombone slide relative to the bell portion of the trombone.

The conventional trombone has a mouthpiece mounted on a fixed length of straight tubing. The mouthpiece is connected through a slide to a bell from which the sound emanates when the instrument is played. The slide consists of two fixed lengths of straight tubing coupled on one end through a sliding U-shaped section of tubing to the bell. The free end of each of the fixed lengths of tubing, or receivers, terminates in a raised section or lip called a stocking. A U-shaped section of tubing forming a slide provides two leg portions, each having an inner diameter slightly greater than the outer diameter of the stockings of the fixed length straight members of the tubing. The slide is slidably mounted on the two fixed-length straight tube members by slipping the slide legs over the inner tube stockings. Lubricant is applied to the stockings before the instrument is played and permits the slide to ride freely along the inner tube members as the player varies length of the tubing through which air travels between the mouthpiece and the bell of the trombone. Extending the tube length of the instrument by a slide rather than by valves, permits a continuous, rather than discrete, change in pitch; this provides a sound unique to the trombone as compared to other wind instruments.

Prior to 1839, the tone sounded by trombones was generally achieved by changing the embouchure and the slide position. In 1839, a thumb-actuated valve was invented by Sattler, in Leipsig. At the time of the invention of this thumb-actuated valve, a standard archectral trombone section consisted of an alto in E♭, a tenor in B♭and a bass in F (i.e., a grouping in perfect fourths). Thus, it was logical to combine the two traditional B♭and F instruments into a single design by adding an F attachment to the standard B♭trombone. Accordingly, it is now quite common for B♭trombones to include an F or perfect-fourth attachment.

One reason for the popularity of the B♭/F instrument appears to be the availability of convenient alternative slide positions/for example, first and second positions with the trigger actuated are equivalent to sixth and seventh positions without the trigger actuated. Thus, many passages can be played without the need for a large change in slide position. Nonetheless the single-trigger, perfect-fourth; design is rather limited for achieving convenient alternate positions. Since many of the perfect-fourth attachment notes have slide positions in; close proximity to corresponding non-attachment notes, there is no particular advantage to using the attachment for these notes.

It is thus an object of the present invention to provide a slide trombone having a thumb-operated single-trigger, minor-third attachment which offers a broad variety of convenient alternative positions. These alternative positions facilitate ease in playing difficult technical passages with a minimal slide movement. Thus, the present invention makes a fuller use of the tones available from the instrument.

In the B♭/G♭embodiment of the present invention, all the notes in the conventional tenor range can be played while permitting the use of a slide having a shorter reach than is conventionally used. The slide is lighter, and accordingly the center of gravity of the trombone is closer to the player's point of support.

DETAILED DESCRIPTION OF THE INVENTION

Figure 1:
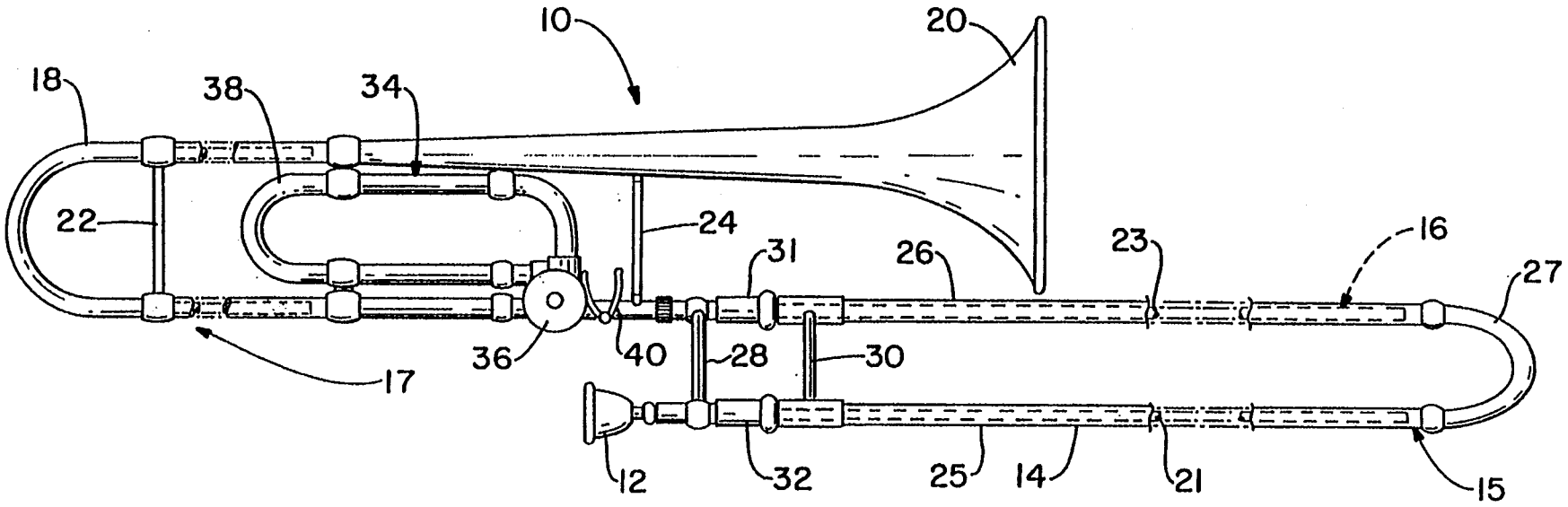
FIG. 1 is a drawing of a short-reach slide single trigger minor third attachment trombone in accordance with the invention.

FIG. 1 shows a short-reach-slide, single trigger, B♭/G tenor trombone in accordance with the present invention. The trombone includes a basic windpath which comprises a slide assembly 15, a tuning loop 17, a mouthpiece 12, and a bell 20. The slide assembly 15 includes an inner slide 16 which has two generally parallel inner tubes, 21, 23. One inner tube 21 is joined to the mouthpiece 12, while the other inner tube 23 is joined to the tuning loop 17.

The slide assembly 15 also includes a generally U-shaped outer slide 14, which includes two generally parallel outer tube members 25, 26, which are in telescoping engagement with the inner tubes 21, 23 of the slide assembly. The outer slide 14 glides along the inner slide 16 to lengthen the length of the windpath and lower the pitch of the trombone accordingly. The pitch of the trombone will depend upon the length of the windpath. Generally speaking, a lower pitch results from a longer path, however, it should be understood that a trombone will resonate at multiple harmonic frequencies for the same length of windpath, the fundamental pitch being the lowest available note for a given windpath. The player selects a given harmonic or tone by adjusting his or her embouchure. The slide position will determine a note selection for any given harmonic.

The slide is positionable from a closed position to the outermost position. This distance is referred to herein as the "reach" of the slide. As used herein, "basic pitch" refers to the fundamental pitch which is produced when the slide is in a closed position.

The tuning loop 17 extends from its joint connecting it with the inner slide 16 and has two generally parallel tube portions joined by a tuning bow 18. The tuning bow 18 can be adjusted in and out in order to tune the trombone to a specific frequency. The tuning loop terminates in a bell 20. The loop is stabilized by a tuning slide brace 22 which can optionally include a counter weight to help balance the weight of the slide assembly as the slide is moved from first position outward. The tuning loop further includes a bell brace 24 which can be positioned in front of or behind the hand of the user which bears the weight of the trombone. The slide assembly includes first and second transfer braces 28 and 30 which help stabilize the inner and outer slides, respectively.

The inner slide 16 includes sleeves 31, 32, which receive the outer slide 14 when it is in a closed position. Generally, the sleeves 31, 32 include a positive stop for the outer slide which can include a spring loaded bumper as is known in the art.

Figure 2:
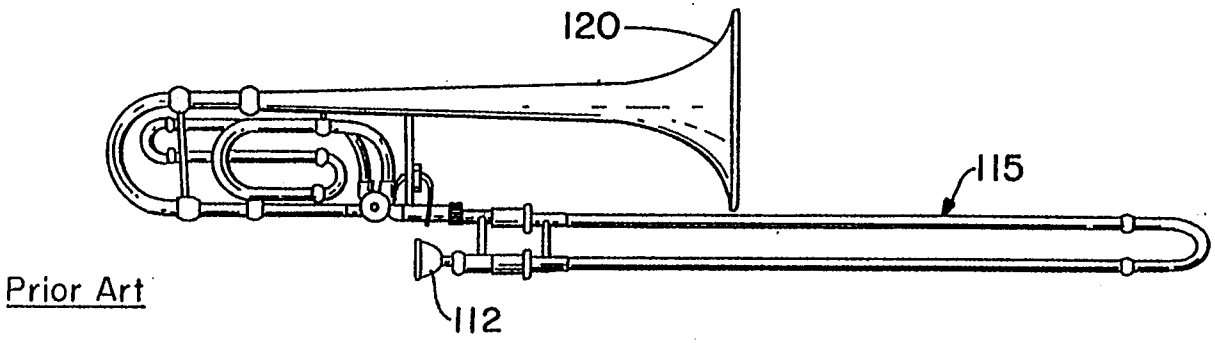
FIG. 2 is a drawing of a B♭/F tenor-trombone of the prior art having a conventional length slide.

For the sake of comparison, FIG. 2 illustrates a conventional B♭/F trombone having a conventional length slide assembly.

Figure 3:
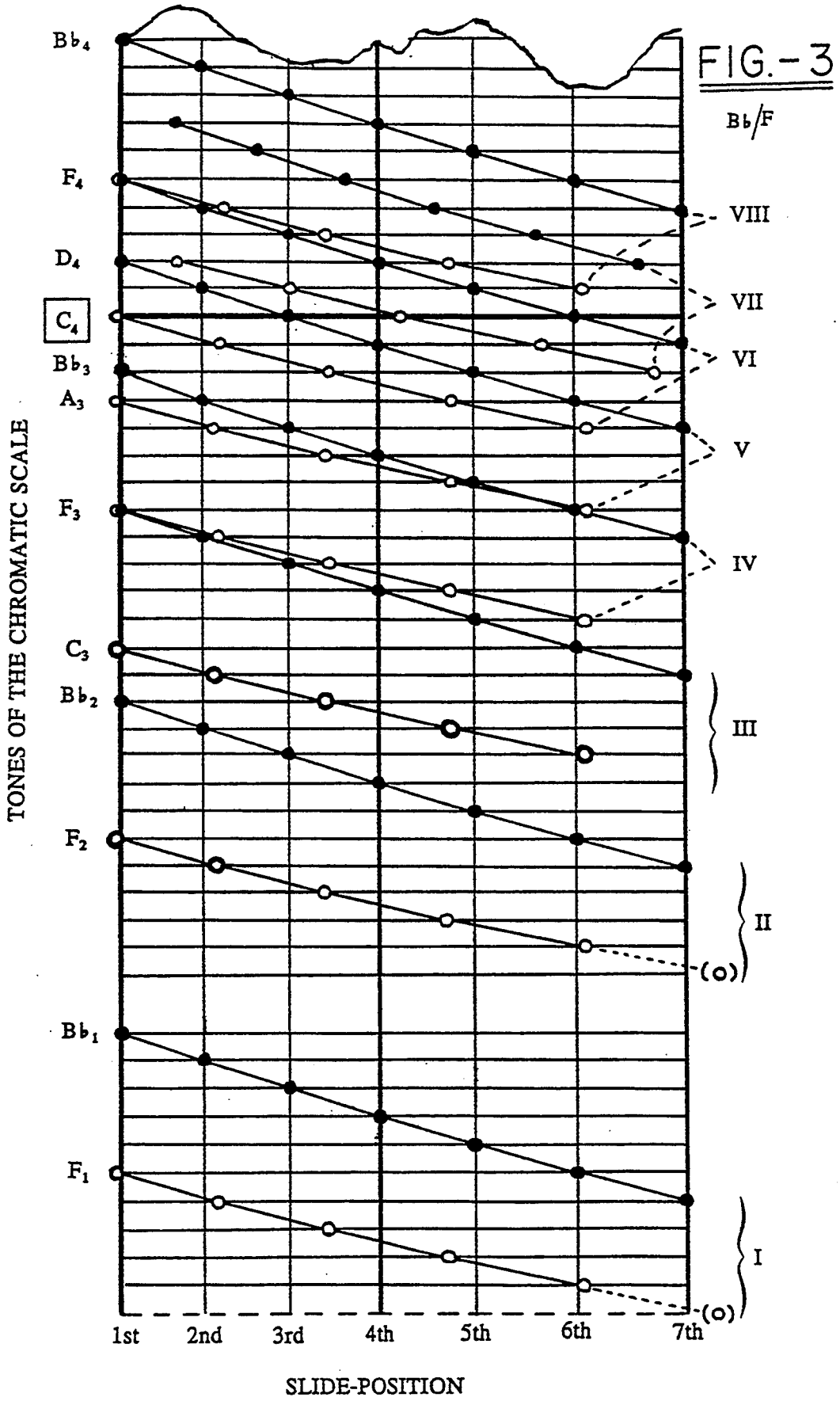
FIG. 3 is the chart of tone versus slide position for a standard B♭/F tenor-trombone.
Figure 4:
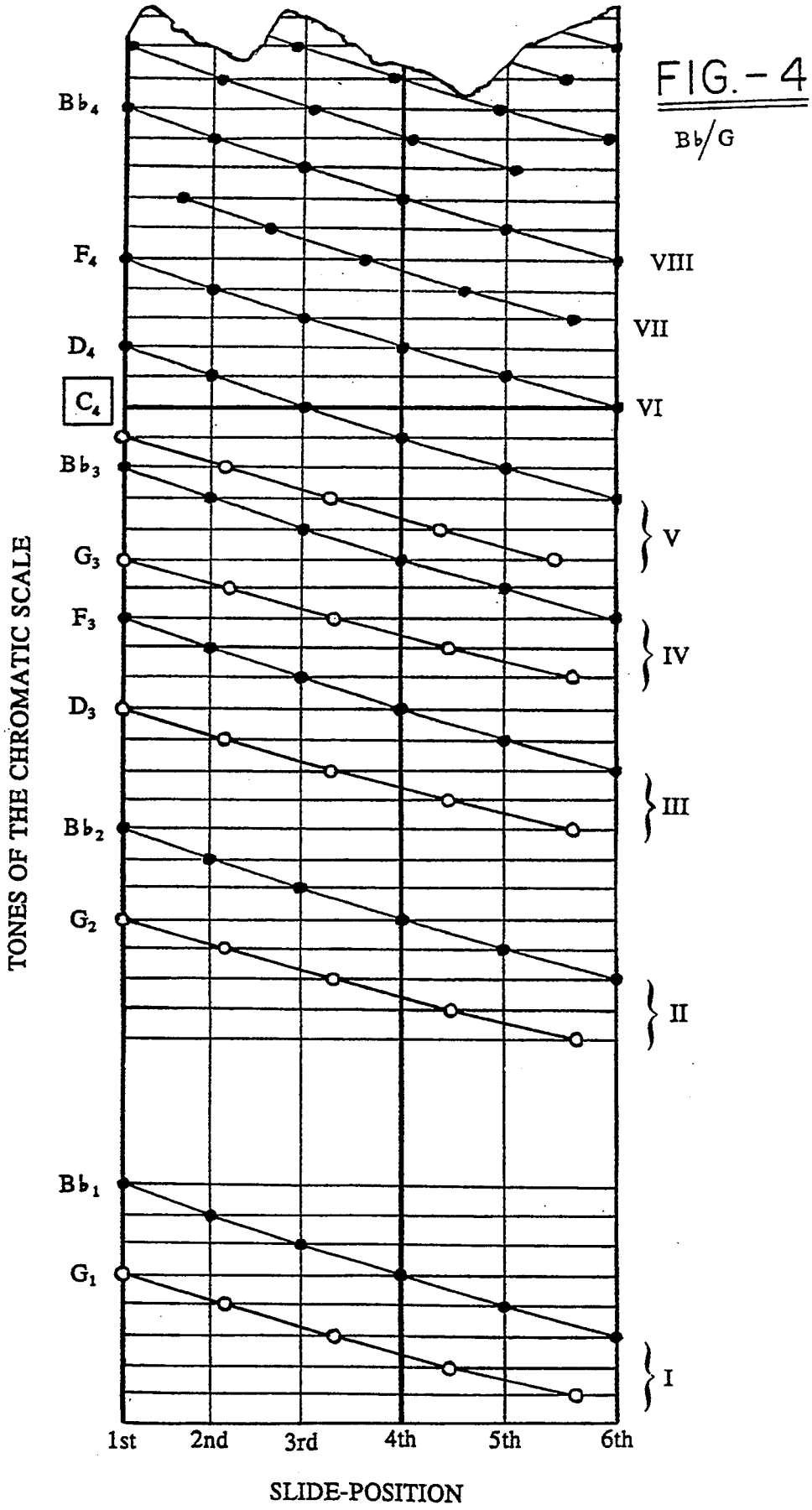
FIG. 4 is a chart of tone versus slide position for a short-reach-slide B♭/G♭ tenor trombone in accordance with the present invention.
Figure 5:
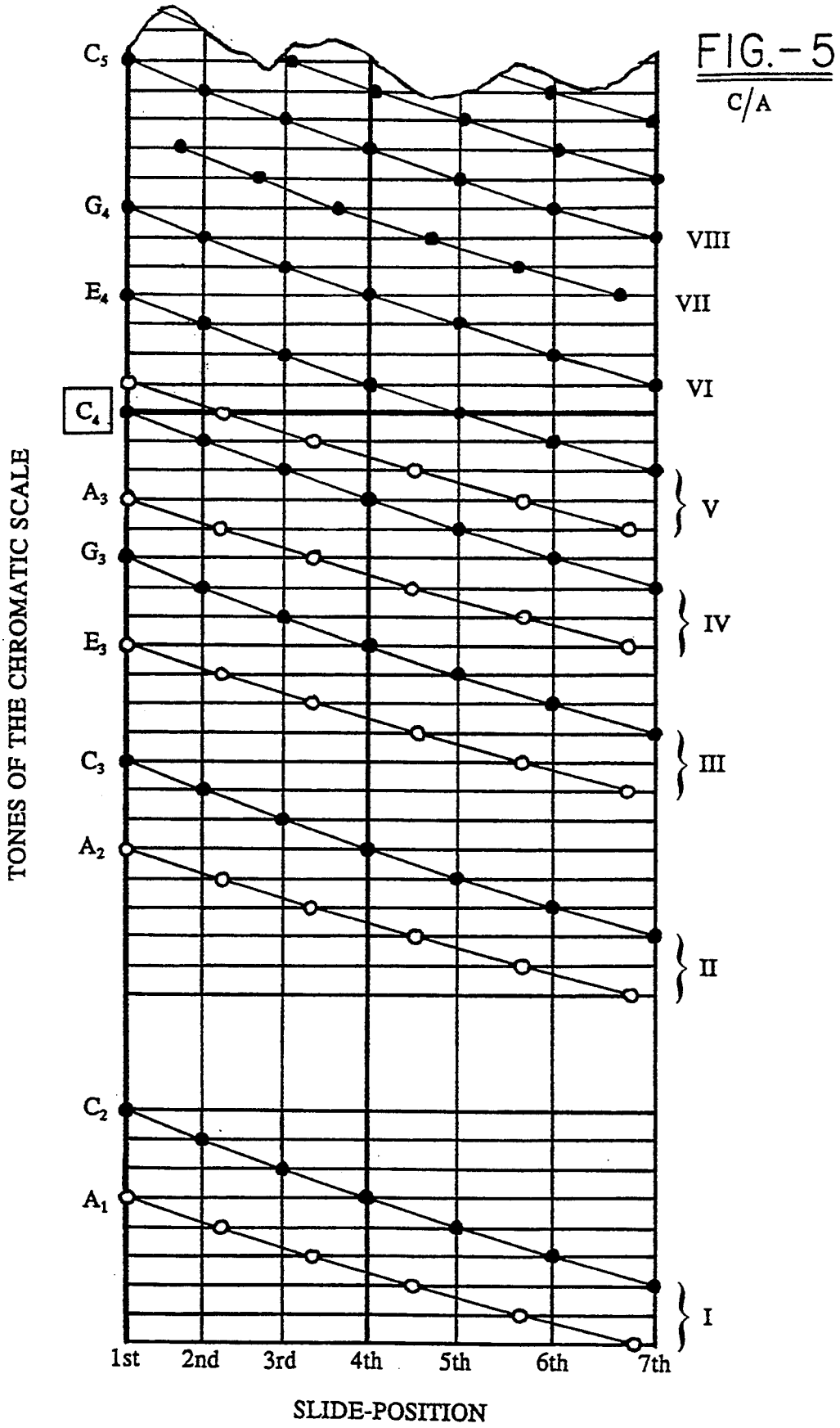
FIG. 5 is a chart of tone versus slide position for a C/A tenor trombone.

FIGS. 3–5 show charts of tone versus slide position for various attachment trombones, in which the Y axis represents the closed position of the slide, and the points on that axis are tones which can be played on a trombone with the slide in a closed position The horizontal lines represent notes of the chromatic scale.

The vertical lines represent relative slide positions for each embodiment of the instrument without the attachment activated, with the first position at the left and the fourth position emphasized for reference. The distance between the successive slide positions increases toward the right according to a geometric progression. The solid dots represent all available positions for the indicated tones without the attachment activated. Open circles show attachment notes. Notes belonging to any given "harmonic" designated by a Roman numeral, are joined by sloping lines. Because of nonuniform compression of harmonic series, many of the upper register's tones do not occur at exactly standard position locations. For example, the seventh, eleventh, and some other higher harmonics are displaced.

The trombone of the present invention includes an attachment 34 which is an assembly including a valve 36 and an attachment tuning loop 38. The valve can be a standard valve as is known in the art, such as a conventional or Yamaha three port rotary valve or a Thayer axial valve, and the tuning loop will be configured accordingly to accommodate the wind passage coming out of and into the valve. The valve is a thumb actuated valve such as by a thumb trigger 40. Various trigger mechanisms and linkages which are suitable are well known in the art. Further, the configuration of the attachment lowers the basic pitch by a minor third. Examples of suitable pitch combinations include B♭/G, C/A tenor , and D♭/B♭F/D alto, with the first tone indicating the basic pitch of the instrument with the slide in first position and the second tone indicating the basic pitch of the instrument with the attachment activated and the slide in the first position. The present invention is applicable for any of the standard bore size trombones, including small, medium, and large bore instruments.

FIG. 3 illustrates a tone slide position chart for the standard B♭/F trombone Notes available with the F attachment are shown by circles. Some of the attachment notes are in convenient alternative positions compared with the basic B♭configuration. Other attachment notes are very close to corresponding non-attachment notes, thereby being of little use.

FIG. 4 illustrates a tone slide position chart for the short-reach-slide B♭/G♭, single-thumb-trigger attachment trombone. In Stark contrast with FIG. 3, the chart of the present invention demonstrates the more uniform interleaving between the harmonics of the attachment and the basic configuration. The tones available on the attachment's second, third and fourth harmonic and also to some extent the fifth harmonic, can all be beneficially utilized in the tenor range. In the conventional prior art as shown in FIG. 3, there are only seven viable alternative attachment positions in the conventional tenor range (i.e., from $E\natural_2$ and higher); these notes are emphasized in the chart by heavier circles. As a practical matter, only four notes are most often used (e.g., $F_2$ and $E\natural_2$, and $C_3$, and $B\natural_2$ in first and second position rather than sixth and seventh position respectively). By contrast as shown in FIG. 4 for the B♭/G♭ trombone of the present invention, there are 19 alternative attachment positions available in the tenor range Nearly all of these positions might be Utilized in normal playing technique. Thus, the advantages of the present invention are obvious.

In addition, FIG. 1 illustrates the short reach slide of the present invention. This slide assembly is used with the B♭/G trombone. The slide has a shorter reach than conventional B♭trombones. Specifically, the slide may be used to lower the basic pitch by five complete semitones, or by four complete semitones when the attachment is activated. the perfect-fourth attachment notes have slide positions in as is used in the present application, generally encompasses the length of the outer slide from the terminus of the outer slide tubes, to the outer diameter of the U-shaped connecting member. More specifically, this reach is the length of the slide movement from first position to the last available or seventh position. The standard reach of a B♭trombone is generally about 62 cm. Whereas in the present invention the reach is not more than 55 cm. In order to keep the tuning of the basic windpath of the short-reach-slide B♭/G♮; trombone in B♭, the length of the tuning bow is adjusted accordingly, i.e., more specifically is lengthened by a corresponding amount that the slide is shortened. The shortening of the slide and corresponding lengthening of the tuning loop causes a shift of the weight distribution of the trombone so that it is most desirably centered in the supporting hand of the player. As a result, the trombone of the present invention allows a more facile playing technique, since the player does not need to work against the torque of gravity as the slide is moved outward.

The lower inertia of the shorter slide in this embodiment adds further to technical facility, giving a lighter feel, and the overall weight redistribution leads to better balance and a more comfortable playing position. The shortening of the slide assembly for the B♭/G♮ trombone of the present invention results in a slide having a reduced number of positions. For example the standard slide has seven positions in the basic windpath and six when the attachment is activated. In accordance with the present invention, the short-reach slide will allow six complete positions in the B♭ windpath, and five complete positions in the G♮ configuration.

While the higher pitched minor-third attachment trombones of the present invention; have slides which enable six complete semitones (i.e, seven positions) in the basic windpath and five complete semitones (i.e., six positions) in the attachment configuration as seen in FIG. 5, for example, these trombones also have a reach which is less than 55 centimeters, since the higher pitch trombones have a shorter windpath with a correspondings shorter slide.

As seen in FIG. 4, in accordance with the B♭/G embodiment of the present invention, B♮2 can be played only in the fourth position on the G attachment's third harmonic. In general, potentially equal weight should be given to the attachment notes and those of the basic configuration, the choice depending on the most convenient position, even for sustained tones. This should be contrasted with conventional B♭/F playing technique in which professional players tend not to use the attachment on sustained notes.

For the trombone which represents the B♭/D♭embodiment of the present invention, it may be particularly advantageous to reverse the trigger action, i.e., so that the actuation of the trigger raises the basic pitch a minor third in contrast to the other embodiments in which the trigger lowers the basic pitch by a minor third.

While in accordance with the Patent Statutes, the best mode and preferred embodiment has been set forth, the scope of the invention is not limited thereto, but rather by the scope of the attached claims.

What is claimed is:

1. A slide trombone having a basic windpath with a length selected to achieve basic pitch comprising:

a mouthpiece, a bell, a slide assembly and a tubular tuning loop, said mouthpiece being joined to said bell by said slide assembly and said tubular tuning loop, said slide trombone having activatable attachment means for lengthening said basic windpath by extending the length of the basic windpath by an amount which will lower the basic pitch of the basic windpath by three semi-tones when activated, said activatable attachment means comprising a valve and a tubular attachment loop, said slide assembly including a tubular inner slide and a tubular outer slide, said inner slide telescoping within said outer slide, said outer slide being outwardly positionable relative to said telescoping inner slide to further lengthen the basic windpath to lower the basic pitch and having a reach of not more than about 55 centimeters.

2. A slide trombone as set forth in claim 1, further comprising a thumb trigger and wherein said valve is a thumb trigger valve.

3. A slide trombone as set forth in claim 2, wherein said valve is either a rotary valve or an axial valve to activate the attachment means.

4. A slide trombone as set forth in claim 3, wherein said basic windpath is tuned to B♭and said attachment means is tuned to G♯.

5. A slide trombone as set forth in claim 1, wherein the pitch of the basic windpath is selected from a group consisting of B♭, C, D♭, E♭and F.

6. A slide trombone having a basic windpath having a length selected to achieve a basic pitch comprising:

a mouthpiece, a bell, a slide assembly, and a tubular tuning loop, said mouthpiece being joined to said bell by said slide assembly and said tubular tuning loop, said slide trombone having activatable attachment means for lengthening said basic windpath by extending the length of the basic windpath by an amount which will lower the basic pitch of the basic windpath by three semi-tones when activated, said activatable attachment means comprising a valve and a tubular attachment loop which lengthens the basic windpath by extending the path from the mouthpiece to the bell, said slide assembly including a tubular inner slide and a tubular outer slide, said inner slide telescoping within said outer slide, said outer slide being outwardly positionable relative to said telescoping inner slide and having a slide length selected to further lengthen the basic windpath by not more than five complete semitones when said attachment means is not activated, and said outer slide being positionable and having said slide length selected to lower the basic pitch of the windpath by not more than four complete semitones when said attachment means is activated and wherein said basic windpath is tune to B♭and said attachment means is tuned to G♮.

7. A slide trombone as set forth in claim 6, further comprising a thumb trigger and wherein said valve is a thumb trigger valve.

8. A slide trombone as set forth in claim 7, wherein said valve is either a rotary valve or an axial valve to activate the attachment means.

9. A slide trombone having a basic windpath having a length selected to achieve a basic pitch comprising:

said basic pitch being selected from a group consisting of C, D♭, E♭, or F, a mouthpiece, a bell, a slide assembly and a tubular tuning loop, said mouthpiece being joined to said bell by said slide assembly and said tubular tuning loop, said slide trombone having activatable attachment means for lengthening said basic windpath by extending the length of the basic windpath by an amount which will lower the basic pitch of the basic windpath by three semi-tones when activated, said activatable attachment means comprising a valve and a tubular attachment loop which lengthens the basic windpath by extending the length, said slide assembly including a tubular inner slide and a tubular outer slide, said inner slide telescoping within said outer slide, said outer slide being outwardly positionable relative to said telescoping inner slide and having a slide length selected to further lengthen the basic windpath to lower the basic pitch of the basic windpath by six semitones when said attachment mean is not activated, and said outer slide being positionable and having said slide length selected to lower the basic pitch of the windpath by five semitones when said attachment means is activated.

10. A slide trombone as set forth in claim 9, further comprising a thumb trigger and wherein said valve is a thumb trigger valve.

11. A slide trombone as set forth in claim 10, wherein said valve is either a rotary valve or an axial valve to activate the attachment means.

12. A slide trombone as set forth in claim 10, wherein said basic windpath is tuned to D♭and said attachment means is tuned to B♭, wherein the thumb trigger is actuated to deactivate the attachment means.

* * * * *